US005111105A

United States Patent [19]

Yamamoto

[11] Patent Number: 5,111,105

[45] Date of Patent: May 5, 1992

[54] VEHICULAR LIGHTING DEVICE

[75] Inventor: Teruaki Yamamoto, Tokyo, Japan

[73] Assignee: PIAA Corporation, Tokyo, Japan

[21] Appl. No.: 628,652

[22] Filed: Dec. 17, 1990

[51] Int. Cl.[5] ..... H01J 5/16

[52] U.S. Cl. ..... 313/112; 313/115

[58] Field of Search ..... 362/255, 256; 313/112, 313/115

[56] References Cited

U.S. PATENT DOCUMENTS 5,017,825 5/1991 Heijnen et al. ..... 313/112

*Primary Examiner*—Carroll B. Dority

*Attorney, Agent, or Firm*—Lyon & Lyon

[57] ABSTRACT

An optical valve for use in a lamp of a motor vehicle comprises a main filament, and a sub-main filament. A multi-layer film is coated over a glass tube at the portion corresponding to the sub-main filament to produce yellow light. When driving at night and passing by a motor vehicle coming from the opposite direction, the sub-main filament is heated and produces yellow light which will not daze a driver's eyes, thus preventing dangerous situations to the drivers.

20 Claims, 2 Drawing Sheets

FIG. 2
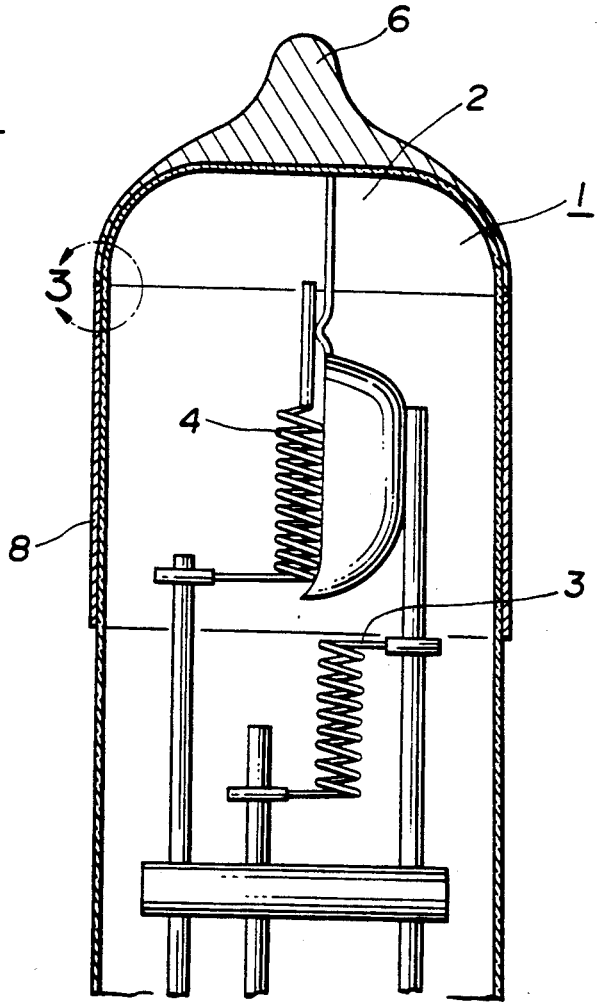
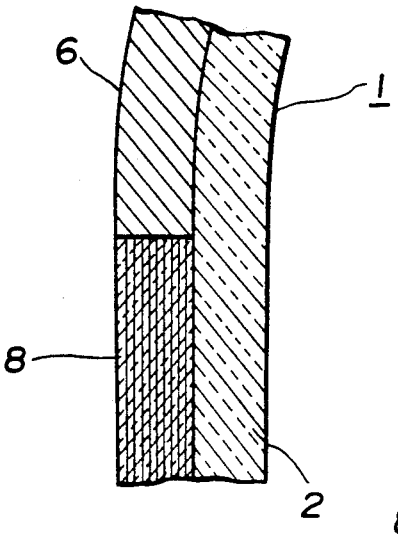
FIG. 3

VEHICULAR LIGHTING DEVICE

BACKGROUND OF THE INVENTION

This invention relates to vehicular lighting devices and more particularly to a bulb for use in a lamp of a motor vehicle.

When driving at night, the glare of the light from the headlight of a motor vehicle coming from the opposite direction may daze the driver's eyes and lead to dangerous or embarrassing situations. To prevent this glare, a bulb, referred to as the "H4" type in this field, has been proposed. This H4 bulb comprises a main filament employed during running periods and a submain filament employed when passing by a motor vehicle coming from the opposite direction.

In detail, the obvious normal procedure during night driving is to employ the main filament when a distant place is desired to be viewed and the sub-main filament when passing by a vehicle coming from the opposite direction so that the other driver is not dazed by the glare of the light from the headlight of the vehicle. However, this prior art lamp bulb proves to be insufficient to eliminate the glaring problem.

SUMMARY OF THE INVENTION

An object of the present invention is to sufficiently provide a lamp bulb for use in a headlight of a motor vehicle to eliminate the above disadvantage.

A vehicular lamp embodying the bulb of the present invention comprises at least two unleveled metallic bars which are displaced parallel with the longitudinal axis of the lamp, a main filament and a sub-main filament, each end of each filament being securely fixed between the two unleveled metallic bars, a lamp bulb having a shielding means, the lamp being coated with a multi-layer film at the portion corresponding to the sub-main filament, the multi-layer film having illumination of yellow color.

With this invention, during driving at night, while the main filament is employed when a distant place is desired to be illuminated, the sub-main filament is employed when passing by a motor vehicle coming from the opposite direction. In the latter, the beam from the sub-main filament produces yellow light by passing through the multi-layer film coated over the lamp at the portion corresponding to the sub-main filament. Accordingly, the yellow beam does never produces the glare which may daze a driver's eyes and thus, prevents dangerous accidents between vehicles.

Other objects and advantages of the invention will become evident during the course of the following description in connection with the accompanying drawings, in which:

FIG. 2 is a sectional view showing a glass tube having a portion coated with a multi-layer film.

FIG. 3 is a sectional view illustrating the circled portion in FIG. 2.

DETAILED DESCRIPTION OF THE INVENTION

Figure 1:
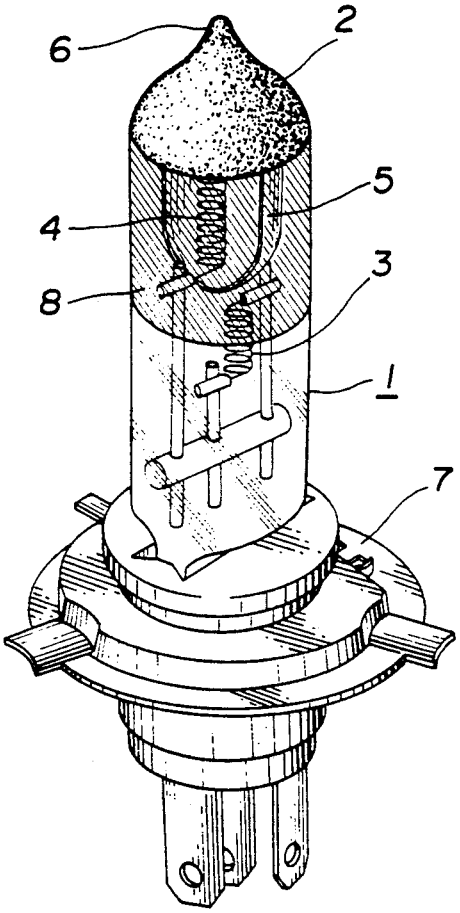
FIG. 1 is a perspective view of a bulb of the present invention.

Referring to the drawings, a bulb 1 referred to as H4 type in this field, comprises a glass tube 2 which includes a main filament or running beam filament 3 and a sub-main filament or pass-by beam main filament 4 which are displaced parallel with the light axis or bulb axis. Alternatively, the main filament 3 may be displaced rearwardly of the sub-main filament 4. A shielding plate 5 is mounted below the subfilament 4. The glass tube 1 has the front end thereof coated with a shielding film 6, as paint, having non light-transmittable property and the rear end thereof provided with a mouthpiece 7. Further, the glass tube 2 at the portion corresponding to the sub-filament 4 is coated with a luminous multi-layer film 8 which produces yellow light. The coating with the multi-layer film 8 is referred to as a "Long Wave Pass Filter (LPT)" in this field. The LPT transmits a specified range of long wavelengths and reflects a range of short wavelengths. It is preferred that the surface of the glass tube 2 be coated by vacuum evaporation, with 20 layer films of $TiO_2$ and $SiO_2$ which are deposited respectively and each of which has thickness of less than 100.

During night driving, while the main filament is to be heated to produce the light which is sufficient to illuminate a distant place, the sub-main filament is to be heated when passing by a motor vehicle coming from the opposite direction. In the latter, the beam from the sub-main filament produces yellow light by passing through the multi-layer film coated over the glass tube 2 at the corresponding portion to the sub-filament 4. In detail, the light is reflected and refracted when passing the mediums of $TiO_2$ and $SiO_2$ having different index of refraction. By the interference of each refracted light, the light is effaced or strengthened and produces yellow light. In this example, the light had the wavelength of more than 500 nm and a transmissivity of more than 90%.

As described above, when a motor vehicle, provided with the bulb of the present invention, drives at night and passes by another vehicle coming from the opposite direction, the sub-main filament is to be heated and produces a yellow light which will not the daze driver's eyes, thus preventing accidents.

While in accordance with the provisions and the statutes, there has been illustrated and described the best form of the invention, certain changes may be made without departing from the spirit of the invention as set forth in the appended claim and in some cases, certain features of the invention may be used to advantage without a corresponding use of other features.

What is claimed is:

1. A lamp bulb, used in a motor vehicle, comprising:
   - a glass tube with a forward and a rearward portion;
   - a sub-main filament positioned in the forward portion of the glass tube;
   - a main filament positioned in the rearward portion of the glass tube, and rearwardly of the sub-main filament; and
   - a luminous film extending to coat only the forward portion of the glass tube forwardly of the main-filament, which filters light emitted from the sub-main filament located in the forward portion of the glass tube.

2. The lamp bulb of claim 1 further comprising a coating of light-shielding material provided at the front end of the forward portion of the glass tube.

3. The lamp bulb of claim 1 having a transmissivity of more than 90% and wherein the emitted light has a wavelength of more than 500 nm.

4. The lamp bulb of claim 1 further comprising:
   - at least two metallic bars displaced, parallel with the axis of the glass tube;

and wherein the main filament is at one end securely affixed to one metallic bar of the at least two metallic bars and the other end is affixed to another of the at least two metallic bars; and the sub-main filament is at one end affixed to one metallic bar of the at least two metallic bars and the other end is affixed to another of the at least two metallic bars.

5. The lamp bulb of claim 4 further comprising a shielding plate mounted adjacent to the sub-main filament.

6. The lamp bulb of claim 5 further comprising a coating of light-shielding material provided at the front end of the forward portion of the glass tube.

7. The lamp bulb of claim 6 having a transmissivity of more than 90% and wherein the emitted light has a wavelength of more than 500 nm.

8. A lamp bulb, used in a motor vehicle, comprising:

a glass tube with a forward and a rearward portion with respect to the longitudinal axis of the path of the light emitted;

a sub-main filament positioned in the forward portion of the glass tube;

a main filament positioned in the rearward portion of the glass tube, and rearward of the sub-main filament; and a luminous multi-layered film extending to coat only the forward portion of the glass tube forwardly of the main-filament, which filters light emitted from the sub-main filament located in the forward portion of the glass tube.

9. The lamp bulb of claim 8 further comprising a coating of light-shielding material provided at the front end of the forward portion of the glass tube.

10. The lamp bulb of claim 8 having a transmissivity of more than 90% and wherein the emitted light has a wavelength of more than 500 nm.

11. The lamp bulb of claim 8 further comprising: at least two metallic bars displaced, parallel with the axis of the glass tube;

wherein the main filament is at one end securely affixed to one metallic bar of the at least two metallic bars and the other end is affixed to another of the at least two metallic bars; and the sub-main filament is at one end affixed to one metallic bar of the at least two metallic bars.

12. The lamp bulb of claim 8 wherein the luminous multi-layer film comprises alternating layers of material, each layer of which has a different index of refraction.

13. The lamp bulb of claim 12 wherein the alternating layers consist of $TiO_2$ and $SiO_2$.

14. The lamp bulb of claim 11 further comprising a shielding plate mounted adjacent to the sub-main filament.

15. The lamp bulb of claim 11 having a transmissivity of more than 90% and wherein the emitted light has a wavelength of more than 500 nm.

16. The lamp bulb of claim 11 wherein the luminous multi-layer film comprises alternating layers of material, each layer of which has a different index of refraction.

17. The lamp bulb of claim 16 wherein the alternating layers consist of $TiO_2$ and $SiO_2$.

18. The lamp bulb of claim 17 further comprising a shielding plate mounted adjacent to the sub-main filament.

19. The lamp bulb of claim 18 further comprising a coating of light-shielding material provided at the front end of the forward portion of the glass tube.

20. The lamp bulb of claim 19 having a transmissivity of more than 90% and wherein the emitted light has a wavelength of more than 500 nm.

* * * * *